US012808129B2

(12) United States Patent
VanderLinden et al.

(10) Patent No.: US 12,808,129 B2
(45) Date of Patent: Nov. 24, 2026

(54) RAIL THREAD BOX ASSEMBLY

(71) Applicant: Transportation IP Holdings, LLC, Norwalk, CT (US)

(72) Inventors: Michael VanderLinden, Knoxville, IA (US); Mark Bachman, Albia, IA (US); Norman Wellings, Agency, IA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 604 days.

(21) Appl. No.: 18/365,072

(22) Filed: Aug. 3, 2023

(65) Prior Publication Data

US 2024/0083471 A1 Mar. 14, 2024

Related U.S. Application Data

(60) Provisional application No. 63/404,741, filed on Sep. 8, 2022.

(51) Int. Cl.
*E01B 29/16* (2006.01)
*B61D 3/16* (2006.01)
(Continued)

(52) U.S. Cl.
CPC ..... *E01B 29/16* (2013.01); *B61D 3/16* (2013.01); *B61D 45/003* (2013.01); *E01B 29/04* (2013.01); *E01B 29/46* (2013.01)

(58) Field of Classification Search
CPC ..... E01B 29/16; E01B 29/17; E01B 29/20; E01B 29/46; E01B 29/04; E01B 29/02; E01B 29/00; B61D 45/003; B61D 3/16
See application file for complete search history.

(56) References Cited

U.S. PATENT DOCUMENTS 3,120,819 A * 2/1964 Gammie ..... E01B 29/17 104/5
5,297,482 A * 3/1994 Cleveland ..... E01B 29/16 104/2

(Continued)

FOREIGN PATENT DOCUMENTS

CN 104746396 A 7/2015
CN 216594098 U 5/2022
FR 2839961 A1 11/2003

OTHER PUBLICATIONS

European Search Report mailed Feb. 5, 2024 for corresponding Application No. EP23193848 (7 pages).

*Primary Examiner* — Cheng Lin
(74) *Attorney, Agent, or Firm* — K&L Gates LLP

(57) ABSTRACT

A thread box assembly includes a framing body coupled with a moveable arm of a thread box system that positions rails of a track. The framing body includes external framing walls with an upward facing open side. The framing body includes framing supporting walls between the external walls. Supporting walls may couple the framing walls with each other. The assembly includes a closing body that can be removably coupled with the framing body. The closing body includes opposing elongated bars and opposing internal coupling walls. The elongated bars are oriented perpendicular to the coupling walls. The closing body is fastened to the framing body to define and surround a central opening of the thread box assembly through which the rails extend during installation or replacement of the track without the closing body moving relative to the framing body.

21 Claims, 7 Drawing Sheets

(51) Int. Cl.

| | |
|---|---|
| ***B61D 45/00*** | (2006.01) |
| ***E01B 29/04*** | (2006.01) |
| ***E01B 29/46*** | (2006.01) |

(56) References Cited

U.S. PATENT DOCUMENTS

| | | | | |
|---|---|---|---|---|
| 6,981,452 | B2 * | 1/2006 | Herzog | E01B 29/17 104/2 |
| 7,350,467 | B2 * | 4/2008 | Green | E01B 29/05 104/7.1 |
| 7,707,943 | B2 | 5/2010 | Herzog et al. | |
| 7,765,935 | B2 | 8/2010 | Bounds | |
| 8,181,577 | B2 * | 5/2012 | Bounds | E01B 29/17 104/5 |
| 8,419,327 | B2 | 4/2013 | Muchlbacher | |
| 8,590,454 | B2 | 11/2013 | Bounds | |
| 9,382,670 | B2 * | 7/2016 | Herzog | B61D 47/00 |
| 9,676,397 | B2 | 6/2017 | Herzog et al. | |
| 9,909,262 | B1 * | 3/2018 | Garcia | E01B 29/16 |
| 2003/0205162 | A1 * | 11/2003 | Herzog | E01B 29/00 104/2 |
| 2008/0141893 | A1 * | 6/2008 | Herzog | E01B 29/16 104/2 |
| 2011/0041721 | A1 | 2/2011 | Bounds | |
| 2017/0108094 | A1 * | 4/2017 | Greer | F16H 7/14 |

* cited by examiner

RAIL THREAD BOX ASSEMBLY

CROSS-REFERENCE TO RELATED APPLICATIONS

This application claims priority to U.S. Provisional Application No. 63/404,741 (filed 8 Sep. 2022), the entire disclosure of which is incorporated herein by reference.

BACKGROUND

Technical Field

The subject matter described herein relates to a rail thread box assembly that supports and directs rails from onboard a rail car to a surface on which the rails are being placed for repair or installation of a track.

Discussion of Art

Rails of a track may be placed onto a surface from onboard a rail car that carries the rails. The rails may be unloaded from the rail car using a variety of different types of equipment, such as winch and pulley systems, thread boxes having multiple moving or pivoting jaws, etc. But these types of systems are complicated and may involve coordinated movement of several moving parts. For example, some thread box assemblies may have opposing pivoting jaws that move toward each other to secure a rail or rail ribbon and that may move away from each other to release or no longer secure the rail or rail ribbon. The movement of both jaws can increase the complexity and labor required to install or replace rails of a track.

A need may exist for a rail thread box assembly that differs from those that currently are available.

BRIEF DESCRIPTION

In one example, a thread box assembly is provided and may include a framing body that can be coupled with a moveable arm of a thread box system that positions rails or rail ribbons for installation or replacement of a track. The framing body may include external framing walls arranged in a general U-shape with an upward facing open side and two of the framing walls opposing each other and the framing walls extending from a plate coupled with the moveable arm, the framing walls extending from the plate to outer ends. The framing body may include framing supporting walls disposed between the external framing walls. The supporting walls may couple the framing walls with each other. The framing walls may be oriented generally parallel to each other and generally perpendicular to the plate. The supporting walls may be oriented generally parallel to each other and generally perpendicular to both the plate and to the framing walls. The assembly also may include a closing body that may include opposing elongated bars and opposing internal coupling walls. The internal coupling walls may connect the bars with each other. The elongated bars may be oriented perpendicular to the coupling walls. The closing body may be removably coupled to the framing body to define and surround a central opening of the thread box assembly through which the rails or rail ribbons extend during installation or replacement of the track without the closing body moving relative to the framing body during installation or replacement of the track.

In another example, a thread box assembly may include a framing body that can be coupled with a moveable arm of a thread box system that positions rails or rail ribbons for installation or replacement of a track. The framing body may include external framing walls extending from a plate coupled with the moveable arm. The external framing walls may extend from the plate to outer ends. The assembly may include a closing body that can include opposing elongated bars. The closing body may be removably coupled to the framing body to define and surround a central opening of the thread box assembly through which the rails or rail ribbons extend during installation or replacement of the track without the closing body moving relative to the framing body during installation or replacement of the track.

In another example, a thread box assembly may include a framing body configured to be coupled with a moveable arm of a thread box system that positions rails or rail ribbons for installation or replacement of a track. The framing body may include external framing walls arranged in a general U-shape, opposing each other, and extending from a plate coupled with the moveable arm. The external framing walls may extend from the plate to outer ends. The framing body may include supporting walls between the external framing walls. The supporting walls may couple the external framing walls with each other. The external framing walls may be oriented parallel to each other and perpendicular to the plate. The supporting walls may be oriented parallel to each other and perpendicular to the plate and to the external framing walls. One of the outer ends of each of the external framing walls may include a first fastener opening shaped to receive a fastener.

The assembly may include a closing body that can include opposing elongated bars and opposing internal coupling walls. The internal coupling walls may connect the bars with each other. The elongated bars may be oriented perpendicular to the coupling walls. One end of each of the elongated bars of the closing body may include a second fastener opening shaped to receive the fastener. The closing body can be removably coupled to the framing body to define and surround a central opening of the thread box assembly through which the rails or rail ribbons extend during installation or replacement of the track without the closing body moving relative to the framing body during installation or replacement of the track. The assembly may include a first roller that can be coupled with the framing body and a second roller that can be coupled with the closing body. The first and second rollers may rotate around parallel axes relative to the framing body and the closing body during passage of the rails or rail ribbons through the central opening.

BRIEF DESCRIPTION OF THE DRAWINGS

The subject matter may be understood from reading the following description of non-limiting embodiments, with reference to the attached drawings, wherein below.

DETAILED DESCRIPTION

Embodiments of the subject matter described herein relate to rail thread box assemblies that hold and direct rail ribbons to a surface for installation or replacement of rails in a track for rail vehicles. One or more embodiments of the rail thread box assemblies may be more robust and simpler to operate than some existing thread boxes, which can reduce faults or defects in operating the thread boxes, can reduce downtime needed to repair the more complex rail boxes, etc.

Figure 1:
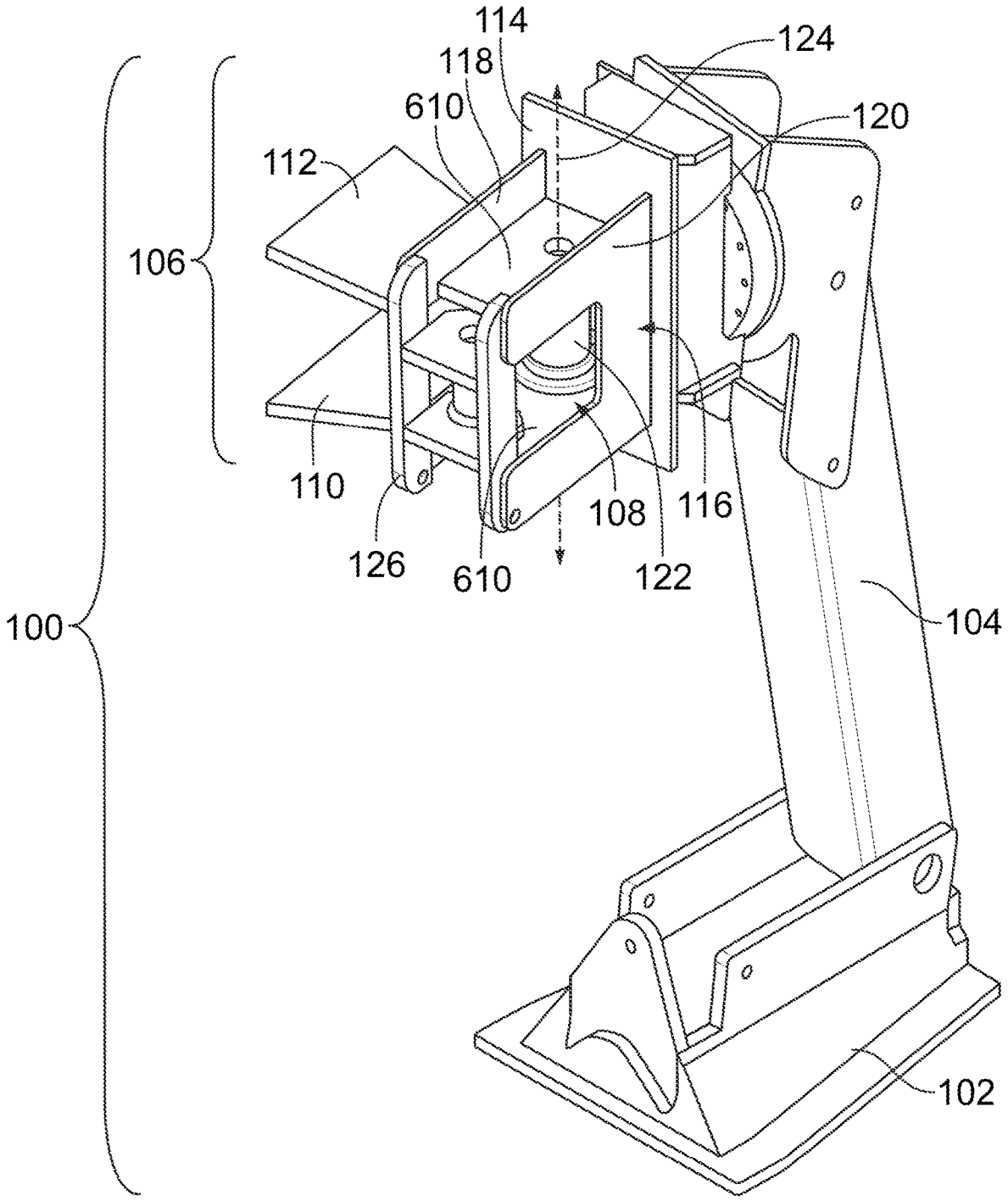
FIG. 1 illustrates a rail thread box system according to one example.
Figure 9:
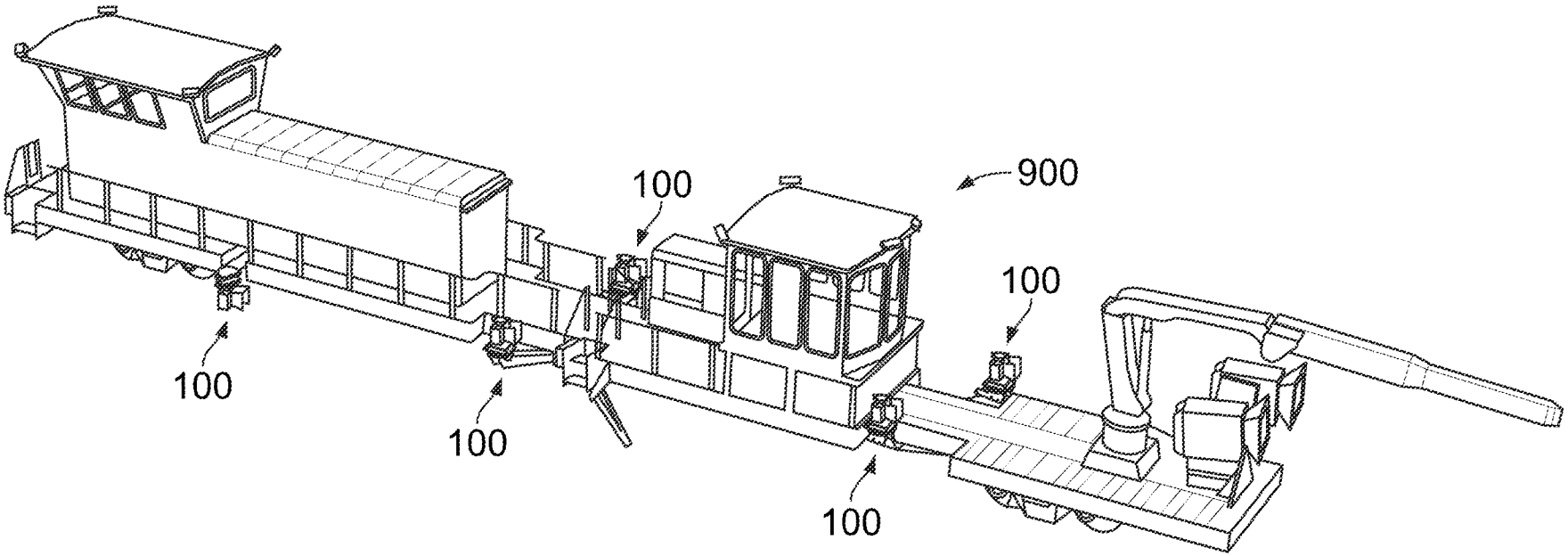
FIG. 9 illustrates one example of a rail car 900 that may include one or more of the rail thread box systems.

FIG. 1 illustrates a rail thread box system 100 according to one example. The rail box thread assembly may include a mount 102 that is coupled with a rail car. FIG. 9 illustrates one example of a rail car 900 that may include one or more of the rail thread box systems. With respect to FIG. 1, an elongated, moveable arm 104 is connected with this mount and extends to a rail thread box assembly 106. The arm may pivot and/or rotate relative to the mount and/or the rail car due to operation of one or more motors coupled with and/or disposed within the arm. For example, the arm may pivot at one end relative to the mount and the thread box assembly may rotate relative to another end of the arm that is opposite the end of the arm that is connected with the mount. The thread box assembly may have a multi-part body that extends around and defines a center opening 108.

Figure 2:
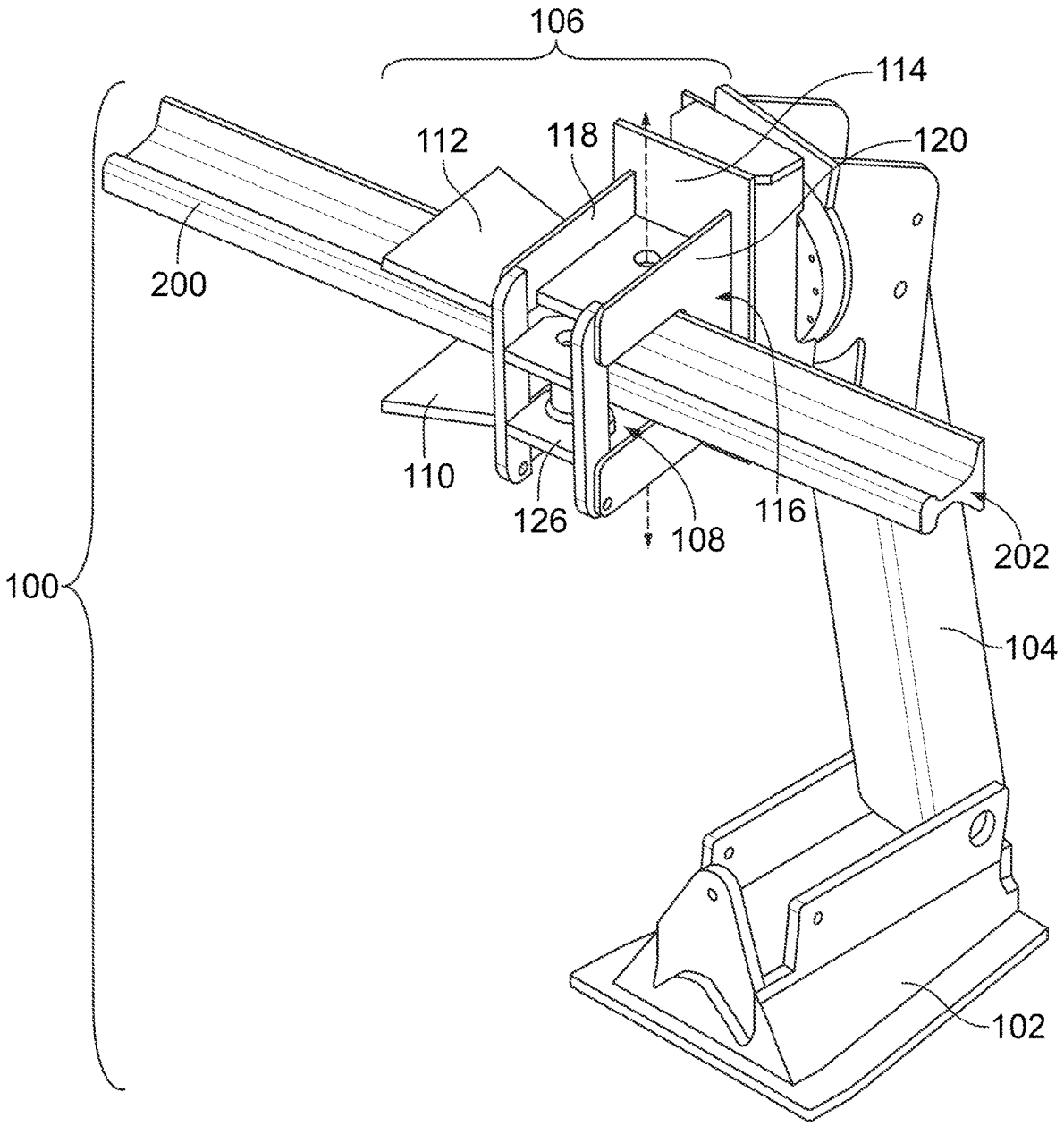
FIG. 2 illustrates the thread box system with one example of a thread box assembly shown in FIG. 1 in a closed state.
Figure 3:
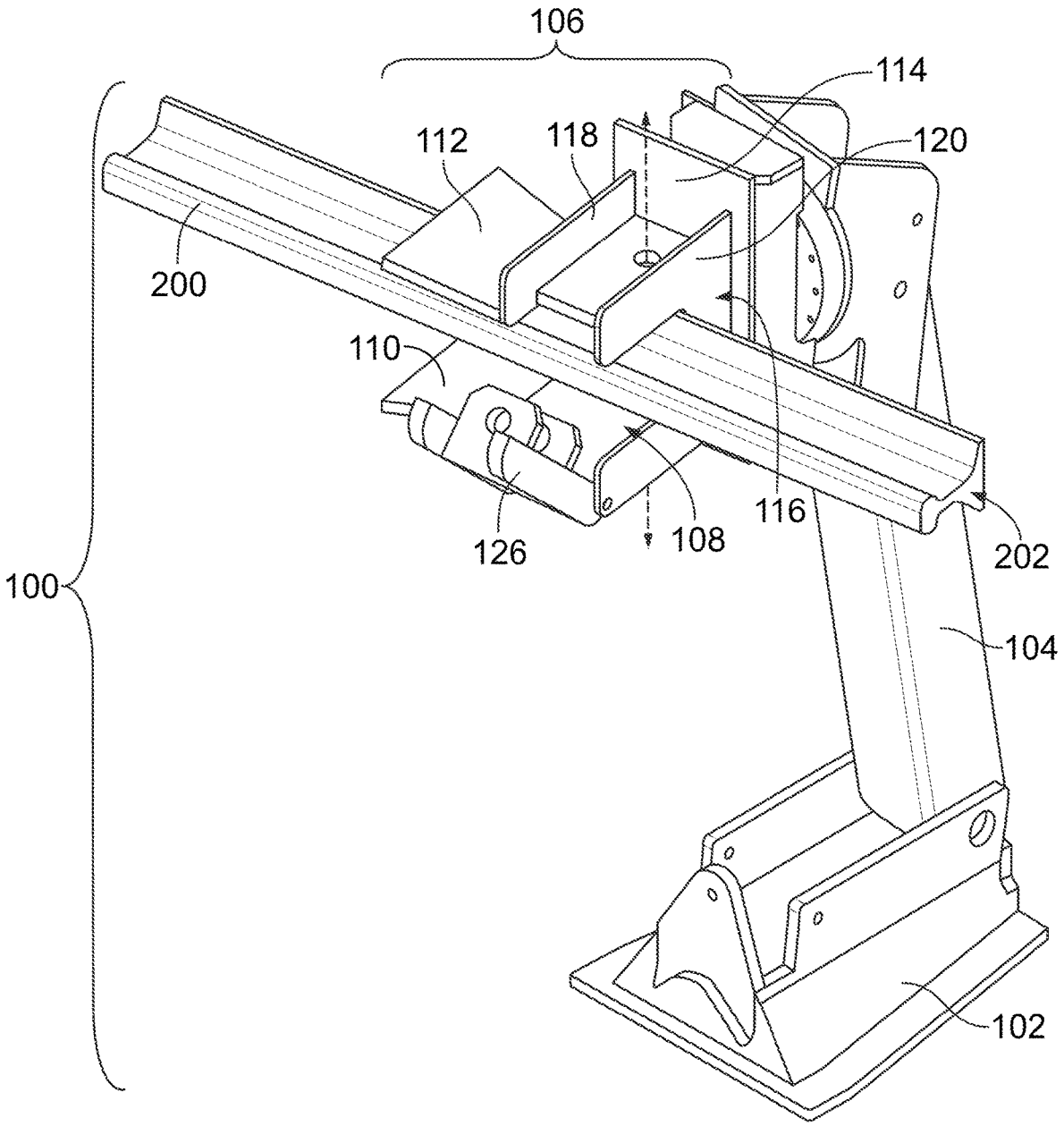
FIG. 3 illustrates the thread box system with one example of the thread box assembly in an open state.
Figure 4:
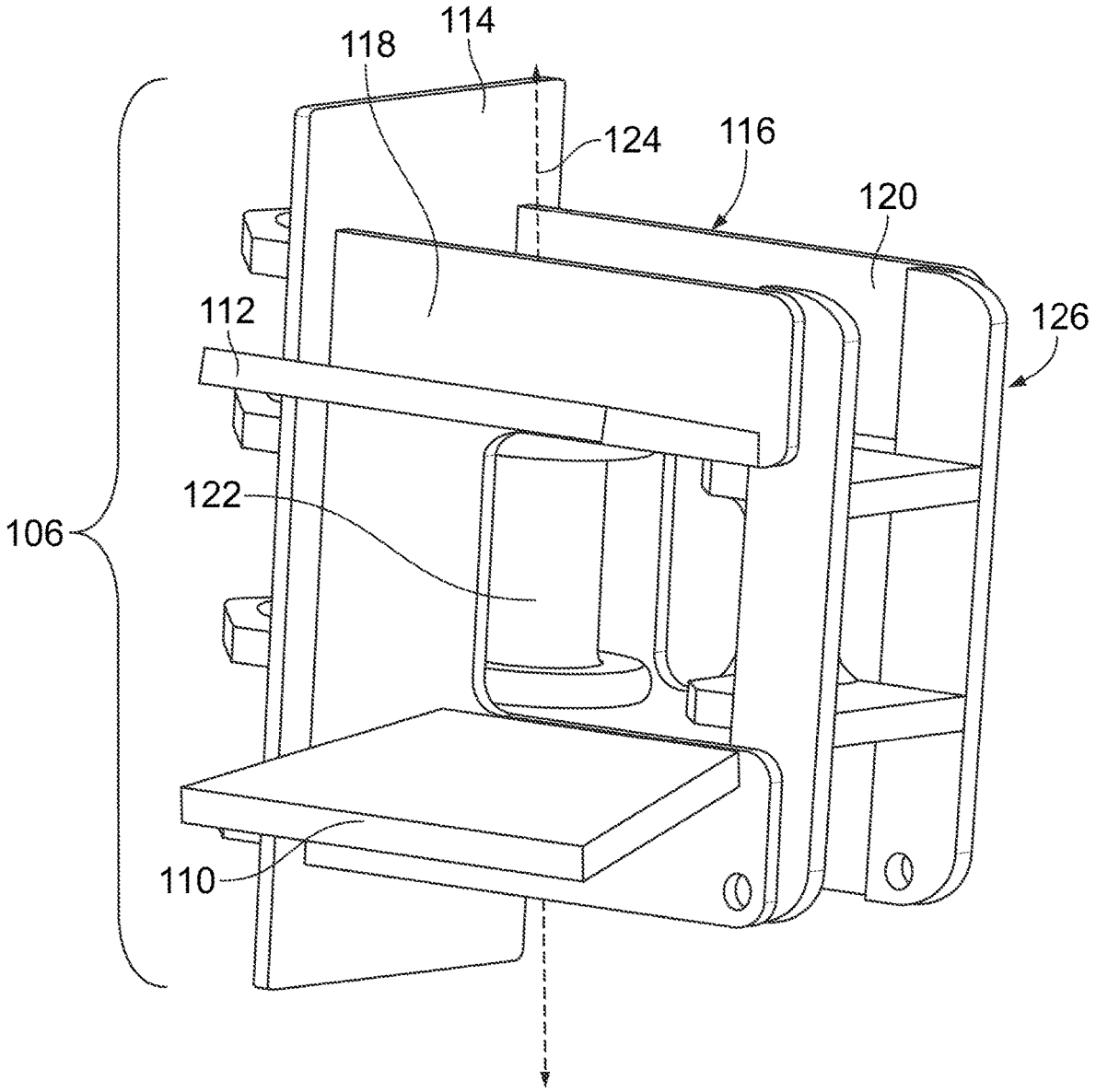
FIG. 4 illustrates a first perspective view of the thread box assembly in the closed state.
Figure 6:
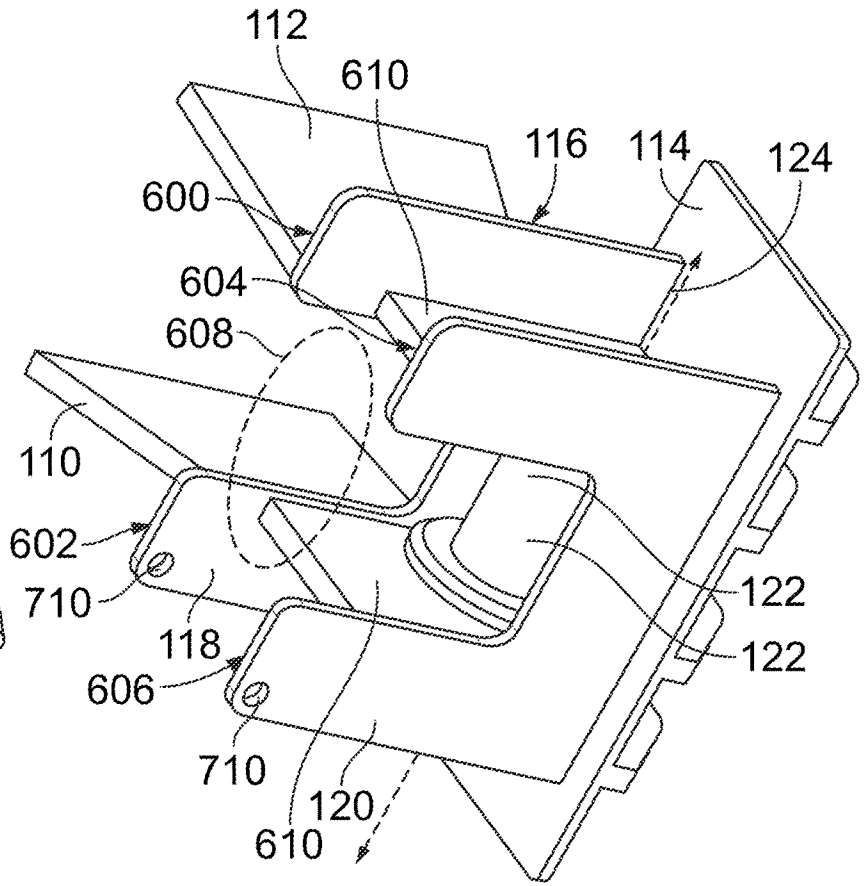
FIG. 6 illustrates another example of the thread box assembly in the open state.
Figure 5:
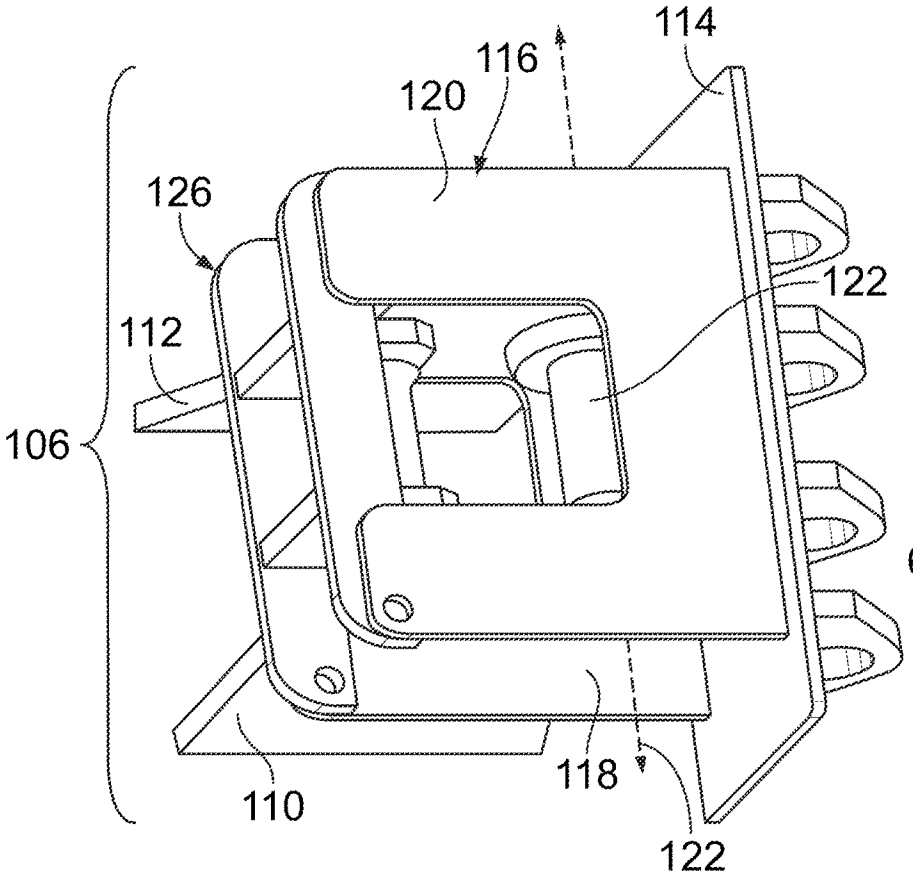
FIG. 5 illustrates a second perspective view of the thread box assembly shown in FIG. 3 in the closed state.

With continued reference to the thread box system shown in FIG. 1, FIG. 2 illustrates the thread box system with one example of the thread box assembly in a closed state, FIG. 3 illustrates the thread box system with one example of the thread box assembly in an open state, FIG. 4 illustrates a first perspective view of the thread box assembly in the closed state, FIG. 5 illustrates a second perspective view of the thread box assembly shown in FIG. 3 in the closed state, and FIG. 6 illustrates another perspective view of the thread box assembly in the open state.

As shown in FIGS. 2 and 3, a rail or rail ribbon 200 may be held by the thread box assembly. The rail or rail ribbon may be placed into the thread box assembly and the arm may move the thread box assembly relative to the rail car and/or the ground so that the thread box assembly can guide the rail or rail ribbon to a position on the ground for installing or replacing a rail of a track. The thread box assembly may have angled ramps 110, 112 that may guide insertion of the rail or rail ribbon into the center opening of the thread box assembly. For example, the ramps may be angled toward each other such that there is an acute angle between the surfaces of the ramps that face toward each other. As shown, the ramps may be arranged in a duck-bill arrangement to form a narrowing or tapered opening into which one end 202 of the rail or rail ribbon may be guided. This end of the rail or rail ribbon may be directed between these ramps, or may engage one or both ramps and slide along the ramp(s), so that the end of the rail or rail ribbon is directed into the center opening.

The thread box assembly may include a plate 114 that is coupled with one end of the arm, as shown in FIGS. 1 and 2. A framing body 116 is coupled with this plate. The framing body may define the general shape of the letter U, as shown in the Figures, or may have another shape in other embodiments that is selected based on application specific requirements. The framing body may include one or more external opposing framing walls 118, 120. The framing walls may have inner surfaces that face each other. In one embodiment, these framing walls may be rigid, while the rigidity may be selected with reference to end use parameters, material selection, and the like. The framing walls and may be oriented generally or about parallel to each other and/or perpendicular to the plate. In various embodiments the framing walls may define the general shape of the letter U. (According to various aspects, unless otherwise specified in a given embodiment, general U-shape and general shape of the letter U are synonymous and refer to an arrangement of two opposing sides connected to a base that together define an opening, like the letter C or the letter U.) One of the sides is an open side, and in one embodiment that open side may be oriented such that the open side is upward facing during normal operation. One edge of each framing wall may be coupled with the plate, with opposite ends 600, 602, 604, 606 (labeled in FIG. 6) of the framing walls projecting away from and disposed away from the plate. These ends of the framing walls are spaced apart from each other to define an opening 608 into the center opening of the thread box assembly.

One or more support walls 610 may be disposed internal to the framing walls, may have a determined rigidity, and may extend between and couple the framing walls with each other, as shown in FIG. 6. The internal supporting walls may face and be oriented parallel to each other, be oriented perpendicular to the framing walls and be oriented perpendicular to the plate. A roller 122 may be coupled with these internal supporting walls. For example, the roller may be elongated and extend from one end coupled with one internal supporting wall to an opposite end that is coupled with the other internal supporting wall. The roller may rotate relative to the internal supporting walls and the framing walls. In the illustrated embodiment, the roller may rotate around or about an axis 124 that extends along or is parallel to the length of the roller. This axis also may be parallel to the surface of the plate and/or perpendicular to the internal supporting walls. One surface or side of the rail or rail ribbon may engage the roller and roll along the roller as the rail or rail ribbon moves through the center opening of the thread box assembly.

In one embodiment, the framing walls 118, 120 are static walls that do not move relative to each other. For example, these framing walls may move together as the entire thread box assembly moves, but each wall 118, 120 is unable to move separately from, in a different direction, etc., than the other wall 120, 118. These walls 118, 120 may be fixed in place and not pivot, rotate, or otherwise move relative to each other, at least in part due to the walls 118, 120 being coupled with each other by the internal walls and being coupled with the plate 114. Fixing these framing walls 118, 120 together so that the walls do not move relative to each other can provide for stronger, more rigid surfaces that the rail or rail ribbon may abut or contact, and can reduce the complexity of moving parts in the overall system relative to other thread boxes having complicated moving parts that may need to be coordinated with each other.

Figure 8:
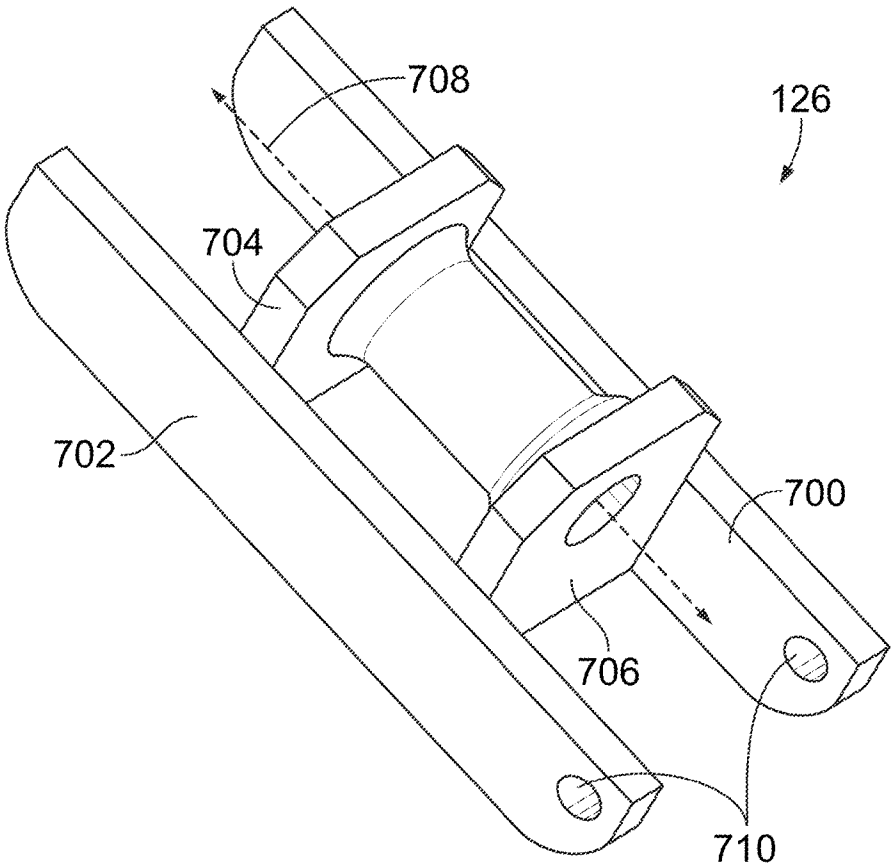
FIG. 8 illustrates a second perspective view of the closing body shown in FIG. 7.
Figure 7:
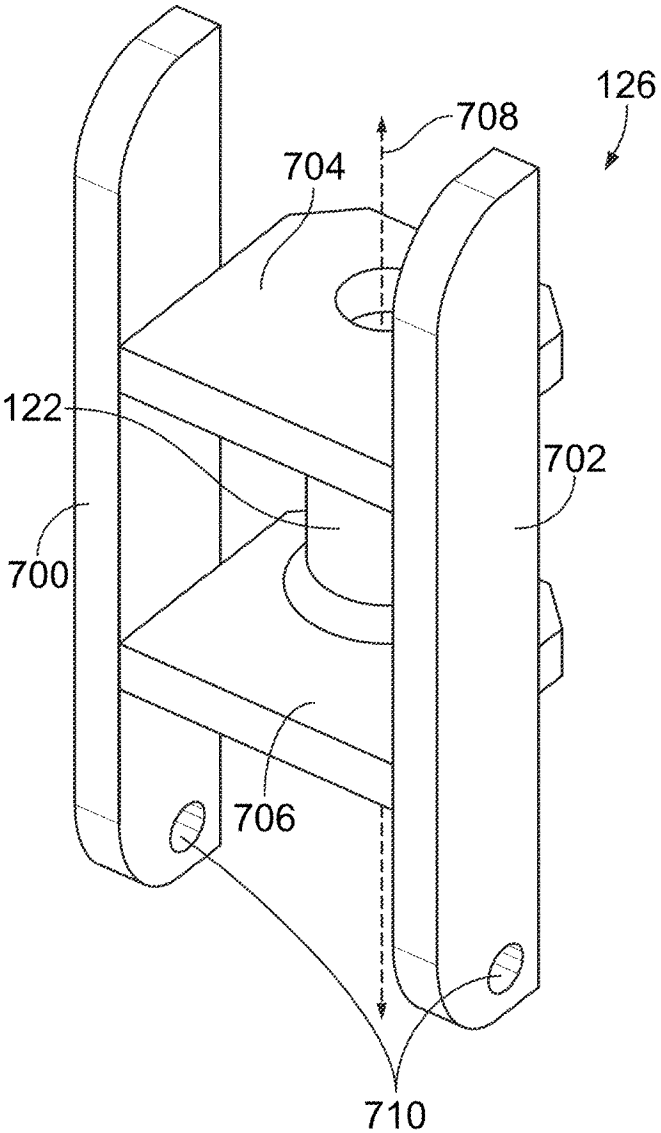
FIG. 7 illustrates a first perspective view of a closing body shown in FIG. 1.

With the opening between the ends of the framing walls, however, the rail or rail ribbon may be at risk of sliding or falling out of the center opening of the thread box assembly. To prevent this from occurring, a closing body 126 may be provided. FIG. 7 illustrates a first perspective view of the closing body shown in FIG. 1 and FIG. 8 illustrates a second perspective view of the closing body shown in FIG. 7. The closing body may be coupled with the framing walls 118, 120 at or near the outer ends of these walls, as shown in FIGS. 1, 2, 4, and 5, and as described herein.

The closing body may be formed from opposing bars 700, 702 (shown in FIG. 7) with internal, opposing coupling walls 704, 706 extending between and coupling the bars with each other. Similar to the framing walls 118, 120, the bars may be fixed in place relative to each other such that the bars cannot move relative to each other. The bars may be parallel to each other with the interconnecting walls disposed perpendicular to the interconnecting walls and parallel to each other.

The opposing bars may be spaced apart by a distance that is sufficiently short for the interconnecting walls to fit between the framing walls 118, 120 of the framing body, as shown in FIGS. 1, 2, 4, and 5. Alternatively, one or both of the opposing bars may not be between the framing walls of the framing body, but one or both of the bars may be disposed outside of the framing walls of the framing body.

Another roller 122 may be coupled with and extend between the interconnecting walls of the closing body. Similar to the other roller, this roller may have one end coupled with one wall 704 and another end coupled with the other wall 706. This roller also may rotate about or around an axis 708 that is oriented parallel to the bars but perpendicular to the walls 704, 706. The axes of rotation for both rollers are parallel to each other in the illustrated embodiment, but alternatively may be perpendicular or oriented at another angle to each other. The rollers may be spaced apart from each other by a distance that allows the rail or rail ribbon to engage and roll along both rollers at the same time. Alternatively, the rollers may be spaced apart by a longer distance such that only one of the rollers engages the rail or rail ribbon at a time.

The closing body may include fastener openings 710 in the bars of the closing body. These fastener openings may only be at or near one end of the bars (e.g., closer to one end of the bars than the opposite end), as shown in FIGS. 7 and 8. The framing walls of the framing body may include fastener openings 710 in two of the ends of the framing walls, but not in the other ends of these walls, as shown in FIGS. 4 through 6. Alternatively, other ends of the framing walls may have the fastener openings.

The fastener openings in the closing body and the framing body may be aligned (e.g., coaxial) with each other when the closing body is coupled with the framing body and rotated into a closed position, as shown in FIGS. 1, 2, 4, and 5. Fasteners, an elongated rod or other body, or the like, may be inserted through the aligned fastener openings to secure one end of the closing body with the framing body. The closing body may be able to pivot or rotate relative to the framing body between the closed position and an open position shown in FIG. 3.

In the closed position, the closing body and the framing body frame and define the central opening of the thread box assembly. The interconnecting walls of the closing body and the internal opposing supporting walls of the framing body may be positioned such that the interconnecting walls of the closing body engage the edges of the internal opposing supporting walls of the framing body. This engagement may ensure that the rollers are disposed at a distance that is sufficiently far to allow passage of the rail or rail ribbon between the rollers (and, optionally, to ensure that the rail or rail ribbon rolls along each of the rollers). The closing body may be pivoted or rotated about the axis through which the fastener openings are aligned to open the thread box assembly. This may occur when a rail or rail ribbon needs to be moved or unstuck, a roller requires maintenance, or the like.

The fewer moving parts of the thread box assembly relative to other thread boxes can reduce the complexity, need for repair, need for maintenance, etc. of the thread box assemblies described herein. There may not be multiple moving parts that require coordination or synchronizing movements of the parts, aside from the stationary rollers that roll as the rail or rail ribbon moves across the rollers. This can reduce the instances of failure and/or maintenance needed for the thread box assemblies described herein relative to other more complex thread boxes.

One or more contact pads (not shown) may be disposed on surfaces that experience friction or wear during normal use. The pads may be formed from a material selected to have a friction or wear profile desirable to the operator. When worn, the pads may be replaced with new pads.

A method for using the thread box assembly may include, at a first step, rotating the closing body to engage with the framing body and define the central opening of the thread box assembly. At a second step, a rail or rail ribbon may be inserted into the central opening. At a third step, the arm coupled with the thread box assembly may move the thread box assembly to a position that directs the rail or rail ribbon onto a surface to install or replace a rail of a track.

In one example, a thread box assembly is provided and may include a framing body that can be coupled with a moveable arm of a thread box system that positions rails or rail ribbons for installation or replacement of a track. The framing body may include external framing walls arranged in a general U-shape with an upward facing open side and two of the framing walls opposing each other and the framing walls extending from a plate coupled with the moveable arm, the framing walls extending from the plate to outer ends. The framing body may include framing supporting walls disposed between the external framing walls. The supporting walls may couple the framing walls with each other. The framing walls may be oriented generally parallel to each other and generally perpendicular to the plate. The supporting walls may be oriented generally parallel to each other and generally perpendicular to both the plate and to the framing walls. The assembly also may include a closing body that may include opposing elongated bars and opposing internal coupling walls. The internal coupling walls may connect the bars with each other. The elongated bars may be oriented perpendicular to the coupling walls. The closing body may be removably coupled to the framing body to define and surround a central opening of the thread box assembly through which the rails or rail ribbons extend during installation or replacement of the track without the closing body moving relative to the framing body during installation or replacement of the track.

The assembly also may include a roller that can be coupled with the framing body and may rotate relative to the framing body during passage of the rails or rail ribbons through the central opening defined by the framing body and the closing body. The assembly may include another roller coupled with the closing body that can rotate relative to the closing body during passage of the rails or rail ribbons through the central opening defined by the framing body and the closing body. The assembly also may include both of these rollers. The rollers may rotate around parallel axes.

Each of the external framing walls may include two of the outer ends. One of the outer ends of each of the external framing walls may include a first fastener opening shaped to receive a fastener. One end of each of the elongated bars of the closing body may include a second fastener opening shaped to receive the fastener. The first fastener openings of the external framing walls and the second fastener openings of the closing body may be positioned to be coaxially aligned with each other to receive the fastener or multiple ones of the fastener to secure the closing body to the framing body. The closing body may pivot relative to the framing body about or around the fastener or fasteners.

In another example, a thread box assembly may include a framing body that can be coupled with a moveable arm of a thread box system that positions rails or rail ribbons for installation or replacement of a track. The framing body may include external framing walls extending from a plate coupled with the moveable arm. The external framing walls may extend from the plate to outer ends. The assembly may include a closing body that can include opposing elongated bars. The closing body may be removably coupled to the framing body to define and surround a central opening of the thread box assembly through which the rails or rail ribbons extend during installation or replacement of the track without the closing body moving relative to the framing body during installation or replacement of the track.

The assembly may include a roller that may be coupled with the framing body and that can rotate relative to the framing body during passage of the rails or rail ribbons through the central opening defined by the framing body and the closing body, and/or another roller coupled with the closing body and configured to rotate relative to the closing body during passage of the rails or rail ribbons through the central opening defined by the framing body and the closing body. The rollers may rotate around parallel axes.

Each of the external framing walls may include two of the outer ends with only one of the two outer ends of each of the external framing walls including a first fastener opening shaped to receive a fastener. One end of each of the elongated bars of the closing body may include a second fastener opening shaped to receive the fastener. The first fastener openings of the external framing walls and the second fastener openings of the closing body may be positioned to be coaxially aligned with each other to receive the fastener or multiple ones of the fastener to secure the closing body to the framing body. The closing body may pivot relative to the framing body about or around the fastener or fasteners.

In another example, a thread box assembly may include a framing body configured to be coupled with a moveable arm of a thread box system that positions rails or rail ribbons for installation or replacement of a track. The framing body may include external framing walls arranged in a general U-shape, opposing each other, and extending from a plate coupled with the moveable arm. The external framing walls may extend from the plate to outer ends. The framing body may include supporting walls between the external framing walls. The supporting walls may couple the external framing walls with each other. The external framing walls may be oriented parallel to each other and perpendicular to the plate. The supporting walls may be oriented parallel to each other and perpendicular to the plate and to the external framing walls. One of the outer ends of each of the external framing walls may include a first fastener opening shaped to receive a fastener.

The assembly may include a closing body that can include opposing elongated bars and opposing internal coupling walls. The internal coupling walls may connect the bars with each other. The elongated bars may be oriented perpendicular to the coupling walls. One end of each of the elongated bars of the closing body may include a second fastener opening shaped to receive the fastener. The closing body can be removably coupled to the framing body to define and surround a central opening of the thread box assembly through which the rails or rail ribbons extend during installation or replacement of the track without the closing body moving relative to the framing body during installation or replacement of the track. The assembly may include a first roller that can be coupled with the framing body and a second roller that can be coupled with the closing body. The first and second rollers may rotate around parallel axes relative to the framing body and the closing body during passage of the rails or rail ribbons through the central opening.

The closing body may be fastened to the framing body to define and surround a central opening of the thread box assembly through which the rails or rail ribbons extend during installation or replacement of the track without the closing body moving relative to the framing body during installation or replacement of the track. The closing body may pivot relative to the framing body about or around the fastener or fasteners.

Use of phrases such as "one or more of . . . and," "one or more of . . . or," "at least one of . . . and," and "at least one of . . . or" are meant to encompass including only a single one of the items used in connection with the phrase, at least one of each one of the items used in connection with the phrase, or multiple ones of any or each of the items used in connection with the phrase. For example, "one or more of A, B, and C," "one or more of A, B, or C," "at least one of A, B, and C," and "at least one of A, B, or C" each can mean (1) at least one A, (2) at least one B, (3) at least one C, (4) at least one A and at least one B, (5) at least one A, at least one B, and at least one C, (6) at least one B and at least one C, or (7) at least one A and at least one C.

As used herein, an element or step recited in the singular and preceded with the word "a" or "an" do not exclude the plural of said elements or operations, unless such exclusion is explicitly stated. Furthermore, references to "one embodiment" of the invention do not exclude the existence of additional embodiments that incorporate the recited features. Moreover, unless explicitly stated to the contrary, embodiments "comprising," "comprises," "including," "includes," "having," or "has" an element or a plurality of elements having a particular property may include additional such elements not having that property. In the appended claims, the terms "including" and "in which" are used as the plain-English equivalents of the respective terms "comprising" and "wherein." Moreover, in the following claims, the terms "first," "second," and "third," etc. are used merely as labels, and do not impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function devoid of further structure.

The above description is illustrative, and not restrictive. For example, the above-described embodiments (and/or aspects thereof) may be used in combination with each other. In addition, many modifications may be made to adapt a particular situation or material to the teachings of the subject matter without departing from its scope. While the dimensions and types of materials described herein define the parameters of the subject matter, they are exemplary embodiments. Other embodiments will be apparent to one of ordinary skill in the art upon reviewing the above description. The scope of the subject matter should, therefore, be determined with reference to the appended claims, along with the full scope of equivalents to which such claims are entitled.

This written description uses examples to disclose several embodiments of the subject matter, including the best mode, and to enable one of ordinary skill in the art to practice the embodiments of subject matter, including making and using any devices or systems and performing any incorporated methods. The patentable scope of the subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A thread box assembly, comprising:

a framing body configured to be coupled with a moveable arm of a thread box system that positions rails or rail ribbons for installation or replacement of a track, the framing body including external framing walls arranged in a general U-shape with an upward facing open side and two of the external framing walls opposing each other and the external framing walls extending from a plate coupled with the moveable arm, the external framing walls extending from the plate to outer ends, the framing body including framing supporting walls disposed between the external framing walls, the supporting walls coupling the external framing walls with each other, the external framing walls being oriented generally parallel to each other and generally perpendicular to the plate, the supporting walls being oriented generally parallel to each other and generally perpendicular to both the plate and to the external framing walls; and a closing body comprising opposing elongated bars and opposing internal coupling walls, the internal coupling walls connecting the bars with each other, the elongated bars oriented perpendicular to the coupling walls, the closing body configured to be removably coupled to the framing body to define and surround a central opening of the thread box assembly through which the rails or rail ribbons extend during installation or replacement of the track without the closing body moving relative to the framing body during installation or replacement of the track.

2. The thread box assembly of claim 1, further comprising a roller coupled with the framing body and configured to rotate relative to the framing body during passage of the rails or rail ribbons through the central opening defined by the framing body and the closing body.

3. The thread box assembly of claim 1, further comprising a roller coupled with the closing body and configured to rotate relative to the closing body during passage of the rails or rail ribbons through the central opening defined by the framing body and the closing body.

4. The thread box assembly of claim 1, further comprising:

a first roller coupled with the framing body; and a second roller coupled with the closing body, the first and second rollers configured to rotate relative to the framing body and the closing body during passage of the rails or rail ribbons through the central opening defined by the framing body and the closing body.

5. The thread box assembly of claim 4, wherein the first roller and the second roller rotate around parallel axes.

6. The thread box assembly of claim 1, wherein each of the external framing walls includes two of the outer ends.

7. The thread box assembly of claim 6, wherein one of the outer ends of each of the external framing walls includes a first fastener opening shaped to receive a fastener.

8. The thread box assembly of claim 7, wherein one end of each of the elongated bars of the closing body includes a second fastener opening shaped to receive the fastener.

9. The thread box assembly of claim 8, wherein the first fastener openings of the external framing walls and the second fastener openings of the closing body are positioned to be coaxially aligned with each other to receive the fastener or multiple ones of the fastener to secure the closing body to the framing body.

10. The thread box assembly of claim 9, wherein the closing body is configured to pivot relative to the framing body about or around the fastener or fasteners.

11. A thread box assembly, comprising:

a framing body configured to be coupled with a moveable arm of a thread box system that positions rails or rail ribbons for installation or replacement of a track, the framing body including external framing walls extending from a plate coupled with the moveable arm, the external framing walls extending from the plate to outer ends; and a closing body comprising opposing elongated bars, the closing body configured to be removably coupled to the framing body to define and surround a central opening of the thread box assembly through which the rails or rail ribbons extend during installation or replacement of the track without the closing body moving relative to the framing body during installation or replacement of the track.

12. The thread box assembly of claim 11, further comprising a roller coupled with the framing body and configured to rotate relative to the framing body during passage of the rails or rail ribbons through the central opening defined by the framing body and the closing body.

13. The thread box assembly of claim 11, further comprising a roller coupled with the closing body and configured to rotate relative to the closing body during passage of the rails or rail ribbons through the central opening defined by the framing body and the closing body.

14. The thread box assembly of claim 11, further comprising:

a first roller coupled with the framing body; and a second roller coupled with the closing body, the first and second rollers configured to rotate relative to the framing body and the closing body during passage of the rails or rail ribbons through the central opening defined by the framing body and the closing body.

15. The thread box assembly of claim 14, wherein the first roller and the second roller rotate around parallel axes.

16. The thread box assembly of claim 11, wherein each of the external framing walls includes two of the outer ends with only one of the two outer ends of each of the external framing walls including a first fastener opening shaped to receive a fastener.

17. The thread box assembly of claim 16, wherein one end of each of the elongated bars of the closing body includes a second fastener opening shaped to receive the fastener, the first fastener openings of the external framing walls and the second fastener openings of the closing body positioned to be coaxially aligned with each other to receive the fastener or multiple ones of the fastener to secure the closing body to the framing body.

18. The thread box assembly of claim 17, wherein the closing body is configured to pivot relative to the framing body about or around the fastener or fasteners.

19. The thread box assembly of claim 11, wherein the closing body is configured to be removably coupled to the framing walls to define and surround the central opening of the thread box assembly through which the rails or rail ribbons extend during installation or replacement of the track without the closing body moving relative to the framing body during installation or replacement of the track.

20. A thread box assembly, comprising:

a framing body configured to be coupled with a moveable arm of a thread box system that positions rails or rail ribbons for installation or replacement of a track, the framing body including external framing walls arranged in a general U-shape, opposing each other, and extending from a plate coupled with the moveable arm, the external framing walls extending from the plate to outer ends, the framing body including supporting walls between the external framing walls, the supporting walls coupling the external framing walls with each other, the external framing walls oriented parallel to each other and perpendicular to the plate, the supporting walls oriented parallel to each other and perpendicular to the plate and to the external framing walls, one of the outer ends of each of the external framing walls includes a first fastener opening shaped to receive a fastener;

a closing body comprising opposing elongated bars and opposing internal coupling walls, the internal coupling walls connecting the bars with each other, the elongated bars oriented perpendicular to the coupling walls, one end of each of the elongated bars of the closing body includes a second fastener opening shaped to receive the fastener, the closing body configured to be removably coupled to the framing body to define and surround a central opening of the thread box assembly through which the rails or rail ribbons extend during installation or replacement of the track without the closing body moving relative to the framing body during installation or replacement of the track;

a first roller coupled with the framing body; and a second roller coupled with the closing body, the first and second rollers configured to rotate around parallel axes relative to the framing body and the closing body during passage of the rails or rail ribbons through the central opening.

21. The thread box assembly of claim 20, wherein the closing body can pivot relative to the framing body about or around the fastener or fasteners.

* * * * *